US012331640B2

(12) United States Patent
Zhang et al.

(10) Patent No.: US 12,331,640 B2
(45) Date of Patent: Jun. 17, 2025

(54) STEERING VALVE FOR DEACTIVATING A STEERING PAD OF A ROTARY STEERABLE SYSTEM

(71) Applicant: Halliburton Energy Services, Inc., Houston, TX (US)

(72) Inventors: Lizheng Zhang, Humble, TX (US); Paravastu Badrinarayanan, Cypress, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 18/737,360

(22) Filed: Jun. 7, 2024

(65) Prior Publication Data

US 2024/0328258 A1 Oct. 3, 2024

Related U.S. Application Data

(63) Continuation of application No. 17/816,912, filed on Aug. 2, 2022, now Pat. No. 12,031,433.

(51) Int. Cl.
*E21B 7/06* (2006.01)
*E21B 34/06* (2006.01)

(52) U.S. Cl.
CPC ..... *E21B 7/06* (2013.01); *E21B 34/06* (2013.01)

(58) Field of Classification Search
CPC . E21B 7/06; E21B 7/062; E21B 34/06; E21B 7/067
See application file for complete search history.

(56) References Cited

U.S. PATENT DOCUMENTS

| | | | | |
|---|---|---|---|---|
| 5,706,905 | A | 1/1998 | Barr | |
| 5,803,185 | A | 9/1998 | Barr et al. | |
| 6,089,332 | A | 7/2000 | Barr et al. | |
| 6,116,354 | A | 9/2000 | Buytaert | |
| 9,121,223 | B2 | 9/2015 | Niina et al. | |
| 12,031,433 | B2 * | 7/2024 | Zhang | E21B 7/06 |
| 2001/0040054 | A1 | 11/2001 | Haugen et al. | |
| 2004/0134687 | A1 | 7/2004 | Radford et al. | |
| 2010/0071962 | A1 | 3/2010 | Beuershausen | |
| 2012/0160563 | A1 | 6/2012 | Clark et al. | |
| 2012/0160565 | A1 | 6/2012 | Downton et al. | |
| 2014/0000966 | A1 | 1/2014 | Fuhst et al. | |
| 2016/0084007 | A1 | 3/2016 | Sugiura | |

(Continued)

OTHER PUBLICATIONS

International Search Report and Written Opinion; PCT Application No. PCT/US2022/074429; mailed Apr. 25, 2023.

(Continued)

*Primary Examiner* — Daniel P Stephenson
(74) *Attorney, Agent, or Firm* — NOVAK DRUCE CARROLL LLP

(57) ABSTRACT

A rotary steerable drilling system can be positioned in a subterranean formation to steer a drill to form a wellbore in the subterranean formation. An orientation of a steering valve, which is positioned in the rotary steerable drilling system, can be adjusted to cover each channel of one or more channels of a valve seat adjacent the steering valve to deactivate each steering pad of one or more steering pads of the rotary steerable drilling system. The orientation of the steering valve can be adjusted to activate at least one steering pad of the one or more steering pads of the rotary steerable drilling system.

20 Claims, 9 Drawing Sheets

(56) References Cited

U.S. PATENT DOCUMENTS

| | | | |
|---|---|---|---|
| 2017/0058617 | A1 | 3/2017 | Bartel |
| 2017/0204671 | A1 | 7/2017 | Laing et al. |
| 2019/0133033 | A1 | 5/2019 | Bringhurst et al. |
| 2020/0003010 | A1 | 1/2020 | Bittleston et al. |
| 2020/0056451 | A1 | 2/2020 | Chambers et al. |
| 2020/0080381 | A1 | 3/2020 | Hardin, Jr. |
| 2020/0199970 | A1 | 6/2020 | Odegbami |
| 2020/0325731 | A1 | 10/2020 | Chambers et al. |
| 2020/0332597 | A1 | 10/2020 | Doud et al. |
| 2020/0332599 | A1 | 10/2020 | Doud et al. |
| 2021/0164292 | A1 | 6/2021 | Deolalikar et al. |
| 2021/0324867 | A1 | 10/2021 | Perisho et al. |

OTHER PUBLICATIONS

International Search Report and Written Opinion, PCT Application No. PCT/US2022/074430; mailed Apr. 27, 2023.

* cited by examiner

STEERING VALVE FOR DEACTIVATING A STEERING PAD OF A ROTARY STEERABLE SYSTEM

CROSS-REFERENCE TO RELATED APPLICATIONS

This application is a continuation of U.S. Non-Provisional application Ser. No. 17/816,912 filed Aug. 2, 2022, which is incorporated herein by reference.

TECHNICAL FIELD

The present disclosure relates generally to wellbore operations and, more particularly (although not necessarily exclusively), to a steering valve for deactivating a steering pad of a rotary steerable system.

BACKGROUND

A wellbore can be formed in a subterranean formation for extracting produced hydrocarbon material or other suitable material. The wellbore may experience or otherwise encounter one or more wellbore operations such as drilling the wellbore. Drilling, or otherwise forming, the wellbore can involve using a drilling system that can include a drill bit and other suitable tools or components for forming the wellbore. During drilling, the drilling system can use a steering pad to change the course of the drill bit by applying pressure to a wall of the wellbore. Deactivating the steering pad can be difficult.

DETAILED DESCRIPTION

Figure 1:
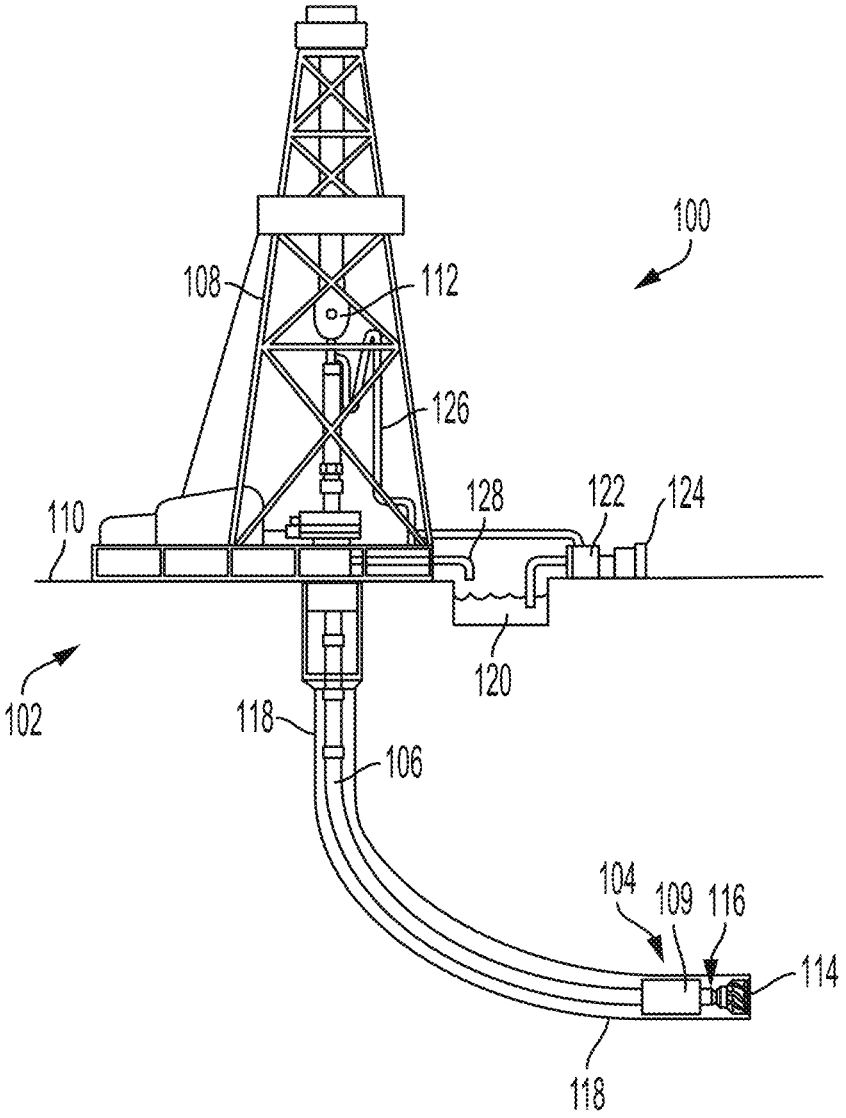
FIG. 1 is a schematic of a well system that can use a rotary steerable system with a steering valve to form a wellbore according to one example of the present disclosure.

Certain aspects and examples of the present disclosure relate to a steering valve that can be used to deactivate a rotary steerable system of a wellbore. The rotary steerable system can be positioned in a wellbore for drilling or otherwise forming a wellbore that may not be linear. For example, the rotary steerable system can include or otherwise be coupled to a drill bit that can be steered to cause a wellbore to be formed. Deactivating the rotary steerable system may involve preventing steering pads of the rotary steerable system from actuating (e.g., outward). When actuated, the steering pads may apply a force to a wall of the wellbore to cause the drill bit to change direction. The steering valve can control which steering pads of the rotary steerable system to actuate. For example, the steering valve can be positioned in the rotary steerable system to allow fluid to flow to one or more steering pads, to prevent fluid from flowing to the steering pads, etc. Fluid flowing to a steering pad may cause the steering pad to actuate. The steering valve can include a cut-off portion that can be used to prevent fluid from flowing to each of the steering pads included in the rotary steerable system for deactivating the rotary steerable system. For example, the cut-off portion can be positioned adjacent to a channel of a valve seat adjacent to the steering valve such that the cut-off portion blocks fluid from flowing to a particular steering pad, while a closed portion of the steering valve are positioned adjacent to remaining channels of the valve seat for blocking fluid from flowing to the remaining steering pads.

Allowing at least one of the steering pads to actuate when fluid flows through a bottom-hole assembly of the wellbore can result in excessive wear on components included in the rotary steerable systems. For example, a steering pad can experience excessive wear, the wellbore can be damaged, and the like. In some examples, steering pads can be mechanically coupled to the rotary steerable systems via a joint that allows the steering pads to rotate with respect to the rotary steerable systems. If the steering pads actuate prematurely, the joint may be subject to unnecessary torque that may not contribute to any steering or adjustment of trajectory associated with the rotary steerable system. The unnecessary torque can degrade the hinge and compromise the structural integrity of some parts of the rotary steerable system. Furthermore, allowing the steering pads to actuate prematurely can result in undesired friction, which can result in excessive wear, between a casing sleeve of a wellbore and the steering pads. Excessive wear on the steering pad can compromise the ability of the steering pad to steer the rotary steerable system.

The steering valve can address the above challenges by causing the steering pads of the rotary steerable system to deactivate. For example, the steering valve can cause the steering pads of the rotary steerable system to be constrained or to be deactivated at an onset of a drilling operation to form the wellbore. In some examples, the steering valve can be used to deactivate the steering pads when passing through a multi-lateral wellbore side-track exit window or in other suitable scenarios. Additionally, the steering valve can be used to deactivate the steering pads or to cut off high-pressure flow to one or more components (e.g., pistons) of the rotary steerable system when not steering to reduce wear or damage to the corresponding components. For example, the steering valve can be used to deactivate the steering pads to reduce wear or damage (thereby extending the useful life thereof) to (i) an elastomer seal of the rotary steerable system, (ii) a metal-to-metal seal of the rotary steerable system, (iii) one or more steering pads, (iv) one or more lateral steering pads or steering pad interfaces, (v) the steering valve, and other suitable components of the rotary steerable system. Additionally, the steering valve can be used to deactivate the steering pads when not steering to reduce noise detected by a mud telemetry system of the wellbore.

The steering valve can include a cut-off portion included in an open portion of the steering valve. For example, a closed portion of the steering valve can include an angle of approximately 240°, and an open portion of the steering valve can include an angle of approximately 120°, though any other suitable angles can be used for the closed position and for the open position of the steering valve. The open portion and the closed portion may be adjacent one another, and the open portion can allow fluid to flow through the rotary steerable system for activating at least one steering pad, while the closed portion can prevent fluid from flowing through the rotary steerable system and may prevent at least one steering pad from actuating.

The cut-off portion can be positioned in the open portion of the steering valve. For example, the cut-off portion may be centrally positioned within the open portion such that the cut-off portion can, at least momentarily during operation of the steering valve, block fluid from flowing through the rotary steerable system, which may prevent the steering pads of the rotary steerable system from actuating. The cut-off portion, for example alternatively to being centrally positioned, may be positioned offset within the open portion of the steering valve. Additionally, an average steering force of the rotary steerable system using the steering valve may not involve a measurable reduction compared to an average steering force of other rotary steerable systems using other steering valves that do not include the cut-off portion. Accordingly, by using the steering valve, a performance of the rotary steerable system can be maintained, while extending the useful life of components of the rotary steerable system and reducing a risk of damaging the wellbore.

In some examples, the steering valve can be used with an existing valve seat of the rotary steerable system. For example, the existing valve seat can include four openings (e.g., channels): (i) three similarly sized and shaped openings corresponding to the steering pads and arranged equidistant from one another on a common radius from a center of the valve seat and (ii) a central opening that allows fluid to return from the rotary steerable system. Other suitable configurations for the valve seat are possible, including configurations in which the openings corresponding to the steering pads are not equidistant, are not on a common radius, and the like. Additionally, the valve seat may include other suitable numbers (e.g., less than four or more than four) openings. The steering valve can be positioned on (e.g., abutting or otherwise adjacent) a face of the valve seat, and the steering valve can be rotated for selecting one or more, or zero, steering pad openings of the valve seat through which to allow fluid flow to activate the corresponding steering pad. In some examples, the steering valve can be positioned with respect to the valve seat such that each of the steering pad openings are blocked. For example, the closed portion of the steering valve can be positioned to block fluid from flowing through a first steering pad opening and a second steering pad opening, while the cut-off portion can be positioned to block fluid from flowing through a third steering pad opening. In such examples, the steering pads of the rotary steerable system may be deactivated or may otherwise not actuate.

These illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

FIG. 1 is a schematic of a well system 100 that can use a rotary steerable system 109 with a steering valve to steer a drill in a wellbore 118 according to one example of the present disclosure. The well system 100 can include the wellbore 118 that can be used to extract hydrocarbons from a subterranean formation 102, though the wellbore 118 may alternatively be positioned in a sub-oceanic formation or any other suitable location. The wellbore 118 can be drilled or otherwise formed using the well system 100. For example, the well system 100 may drive a bottom hole assembly (BHA) 104 positioned or otherwise arranged at the bottom of a drill-string 106 extended into the subterranean formation 102 from a derrick 108 arranged at the surface 110. The derrick 108 can include a kelly 112 that can be used to lower and raise the drill-string 106.

The BHA 104 may include a drill bit 114, a rotary steerable system 109, other suitable components, or any suitable combination thereof. The drill bit 114 can be operatively coupled to a tool string 116, and the drill bit 114 may be moved axially within a drilled wellbore 118 and can be attached to the drill-string 106. During operation, the drill bit 114 can penetrate the subterranean formation 102 to create the wellbore 118. The BHA 104 can control the drill bit 114 as the drill bit 114 advances into the subterranean formation 102. For example, the rotary steerable system 109 can control a direction of drilling by applying a steering pressure or other suitable force to a wall of the wellbore 118. The steering pressure, for example an amount of pressure, a direction of pressure, or the like, can be controlled with a steering valve included in the rotary steerable system 109.

Fluid or "mud" from a mud tank 120 may be pumped downhole using a mud pump 122 that can be powered by an adjacent power source, such as a prime mover or motor 124. The mud may be pumped from the mud tank 120, through a stand pipe 126, which can feed the mud into the drill-string 106, the rotary steerable system 109, or other suitable components of the well system 100 and can convey the mud to the drill bit 114. The mud can exit one or more nozzles (not shown) arranged in the drill bit 114 and can thereby cool the drill bit 114. Additionally or alternatively, the mud can be directed (e.g., as pressurized mud) into the rotary steerable system 109 for adjusting a direction of the drill bit 114. In some examples, the steering valve can control, for example an amount, a direction, or the like, the mud being directed into the rotary steerable system 109. After exiting the drill bit 114 or other suitable component, the mud can circulate back to the surface 110 via the annulus defined between the wellbore 118 and the drill-string 106. Cuttings and mud mixture that can be passed through a flow line 128 can be processed such that a cleaned mud is returned down hole through the stand pipe 126.

The rotary steerable system 109 can include a steering collar, an actuation cylinder, a seal, the steering valve, and any other suitable components. The steering collar can provide a rigid frame for the rotary steerable system 109, and the actuation cylinder can include a piston that can be used to apply the steering pressure or other suitable forces for causing steering pads of the rotary steerable system 109 to actuate outwards. The seal can be positioned between the steering collar and the actuation cylinder for forming a pressure seal or other suitable type of seal in the rotary steerable system 109. For example, the seal can allow the rotary steerable system 109 to receive pressure (e.g., via pressurized mud, etc.) that can be used to apply the steering force. The steering valve can be used to control the received pressure to cause the steering pads to actuate. For example, the steering valve can be positioned in the rotary steerable system 109 such that zero, one, two, or any other suitable numbers of steering pads are actuated.

Figure 2:
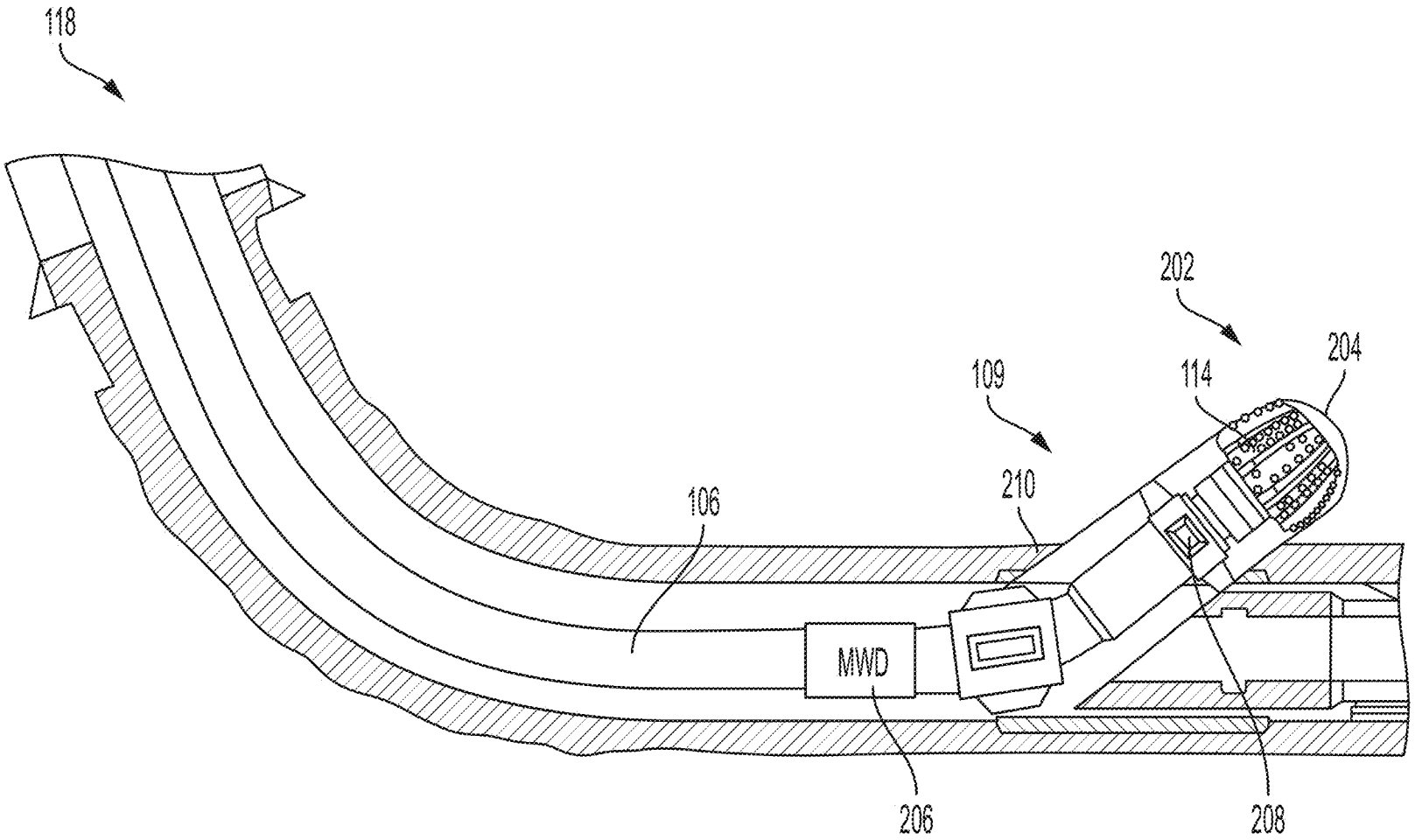
FIG. 2 is a schematic of a wellbore with a rotary steerable system forming a lateral wellbore according to one example of the present disclosure.

FIG. 2 is a schematic of a wellbore 118 with a rotary steerable system 109 steering a drill 202 for forming a lateral wellbore 204 according to one example of the present disclosure. The rotary steerable system 109 can be operably coupled to the drill bit 114, the drill-string 106, a measurement device 206, any other suitable component of a drilling operation, or any suitable combination thereof. For example, and as illustrated, the rotary steerable system 109 is coupled to the drill 202, which includes the drill bit 114, the drill-string 106, and the measurement device 206, which is depicted as a measuring-while-drilling (MWD) device.

The rotary steerable system 109 can be used to change a direction of the drill 202. For example, the steering valve can cause one or more steering pads, such as steering pad 208, to actuate (e.g., outward). By actuating, the steering pad 208 may apply a steering force against a wall of the wellbore 118. For example, the rotary steerable system 109 can cause the steering pad 208 to actuate for causing the drill 202 to change trajectory, for example away from the wellbore 118, for forming the lateral wellbore 204. In some examples, the rotary steerable system 109 may progress through an aluminum casing exit joint 210.

The rotary steerable system 109 may prevent the steering pad 208, and other steering pads included in the rotary steerable system 109, from actuating while the rotary steerable system 109 is passing through the aluminum casing exit joint 210. The aluminum casing exit joint 210 may be fragile or may otherwise be susceptible to damage, for example from an actuated steering pad of the rotary steerable system 109. The rotary steerable system 109 can cause the steering valve to prevent fluid from flowing to the steering pads of the rotary steerable system 109 to prevent the steering pads from actuating. Accordingly, the steering pads of the rotary steerable system 109 can be deactivated by the steering valve while the rotary steerable system 109 passes through the aluminum casing exit joint 210, and the aluminum casing exit joint 210 may not incur damage.

Figure 3:
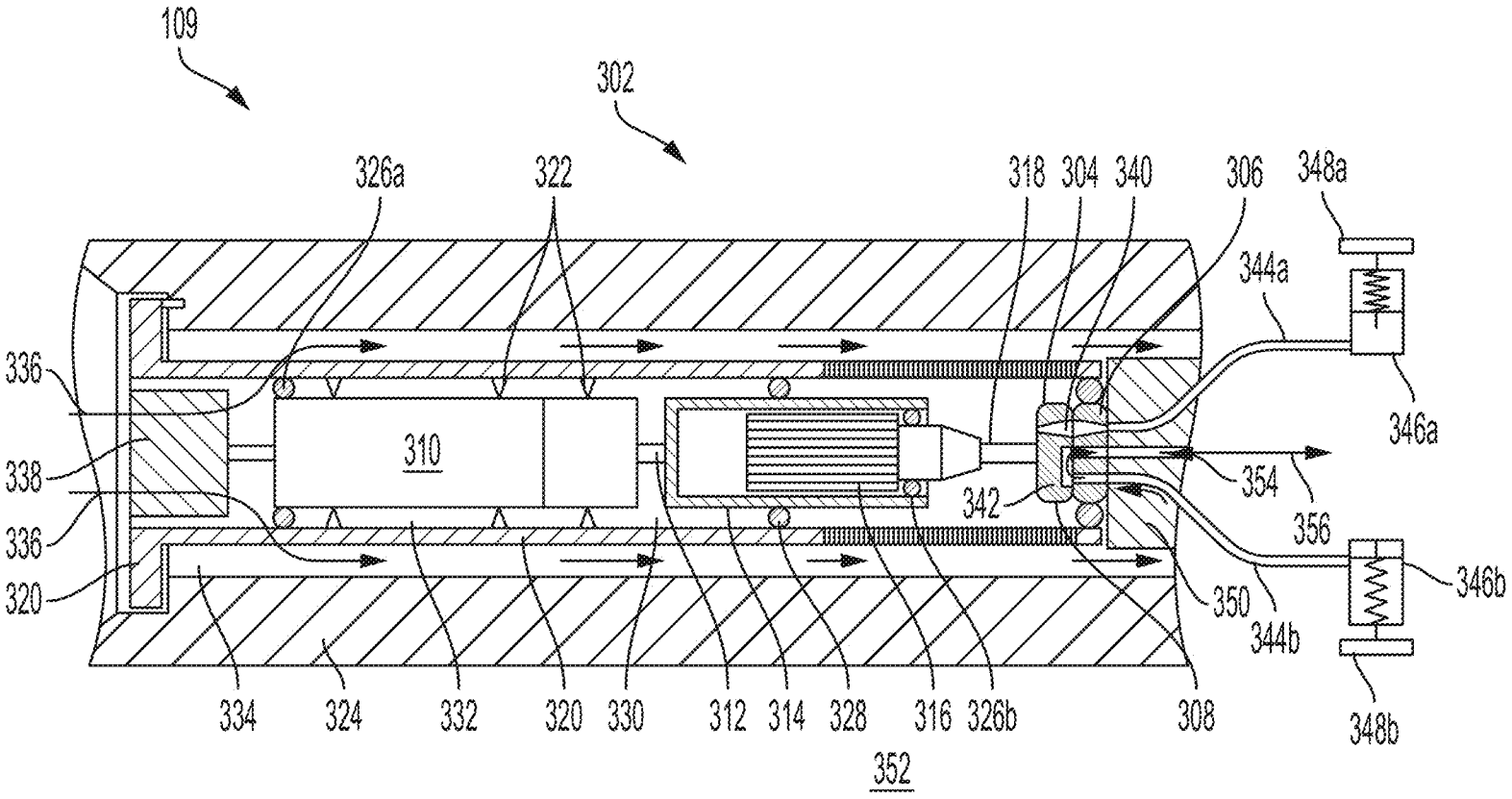
FIG. 3 is a sectional side-view of a rotary steerable system with a steering valve according to one example of the present disclosure.

FIG. 3 is a sectional side-view of a rotary steerable system 109 with a steering valve according to one example of the present disclosure. The rotary steerable system 109 can include a steering valve actuation unit 302 with a steering valve 304 that is engaged with a valve seat 306. An end 308 of the steering valve 304 engages the valve seat 306 while the steering valve 304 is rotated relative to the valve seat 306 by a motor 310. The motor 310 can be any suitable device that can control rotation of the steering valve 304 such as a mud motor, electric motor, turbine motor, actuator, etc. As illustrated, the motor 310 is coupled with a drive shaft 312 coupled to the steering valve 304 via a splined hub 314 which is mated to a splined shaft 316. The splined shaft 316 can be attached to a support structure 318 on which the steering valve 304 is mounted. Thus, rotating the drive shaft 312 can rotate the steering valve 304 relative to the valve seat 306.

The motor 310 can be mounted within a valve housing 320 via supports 322, with the valve housing 320 mounted within a tool housing 324, as shown. Accordingly, the motor 310 can be coupled to the valve seat 306 via the valve housing 320, since a manifold (not shown) can be attached to the valve housing 320 and the tool housing 324. The valve seat 306 can be fixedly attached or otherwise coupled to the manifold which can permanently align ports in the valve seat 306 with flow paths in the manifold. Thus, the tool housing 324, the valve housing 320, the motor 310, the valve seat 306, and the manifold, etc., rotate with the drill bit 114. The motor 310 can rotate the drive shaft 312 relative to the valve housing 320, thereby rotating the steering valve 304 relative to the valve seat 306. It should be noted that the steering valve 304 and valve seat 306 can be held in engagement with each other by an engagement force.

Seals 326*a-b* and compensation piston 328 can seal off a volume 330 within the valve housing 320 that can contain clean oil 332 for lubricating moving parts of the steering valve actuation unit 302 included in the volume. The clean oil 332 can be separated from the drilling mud 334 by the seals 326*a-b* and the compensation piston 328 to prevent damage of drive components, such as the motor 310, the splined hub 314, and the shaft 316, due to degrading elements, abrasive particulates, corrosive agents, caustic chemicals, in the drilling mud. The seal 326*a* can be a stationary seal that seals between the motor 310 and the valve housing 320. The compensation piston 328 can seal between the valve housing 320 and the splined hub 314 that rotates relative to the valve housing 320. But, the compensation piston 328 can also rotate with the splined hub 314 while maintaining a seal with the valve housing 320 that does not rotate with the splined hub 314. The compensation piston 328 can also provide pressure equalization between the volume 330 and the drilling mud 334 by providing pressure communication between the volume 330 and the drilling mud 334. The seal 326*b* can rotate with the splined hub 314 and the splined shaft 316 when the drive shaft 312 rotates and can seal between the splined hub 314 and the splined shaft 316. The seals 326*a-b* and the compensation piston 328 can create the volume 330 that can contain the clean oil 332.

Fluid flow 336 of the drilling mud 334 can flow through a turbine 338, which causes the turbine 338 to rotate. The rotation of the turbine 338 can generate electricity to power an electric drive for rotating the drive shaft 312. The turbine 338 can also provide rotation of the drive shaft 312 directly or through various other motor configurations to control the steering valve actuation unit 302. As the drive shaft 312 rotates, the splined hub 314 coupled to the splined shaft 316 can transfer the rotational motion of the drive shaft 312 to rotational motion of the steering valve 304. As the steering valve 304 rotates relative to the valve seat 306, a gap 340 and recess 342 selectively align with flow paths 344*a-b* or more, if applicable. As illustrated, the gap 340 can be aligned with the flow path 344*a*, which can allow the pressurized drilling mud 334 to enter the flow path 344*a* via a port or channel in the valve seat 306, which can pressurize a first actuator, such as piston 346*a*, to extend an extendable pad 348*a*. A second flow path 344*b* can be aligned with the recess 342, which can direct fluid flow 350 from the second flow path 344*b* to be released to the annulus 352 or other low-pressure volume via flow path 354 as fluid flow 356, which may deactivate a second actuator, illustrated as piston 346*b*, and retracting pad 348*b*. As the steering valve 304 rotates, the gap 340 can miss-align from the flow path 344*a* and align with the second flow path 344*b*, thereby pressurizing the piston 346*b* to extend the pad 348*b*, and allowing the piston 346*a* to depressurize via the recess 342 and the flow path 354 to the annulus 352. Accordingly, the extendable pad 348*a* can retract. The selective activation of the pistons 346*a-b*, or more if applicable, can selectively extend and retract the pads 348*a-b*, or more if applicable.

Figure 4:
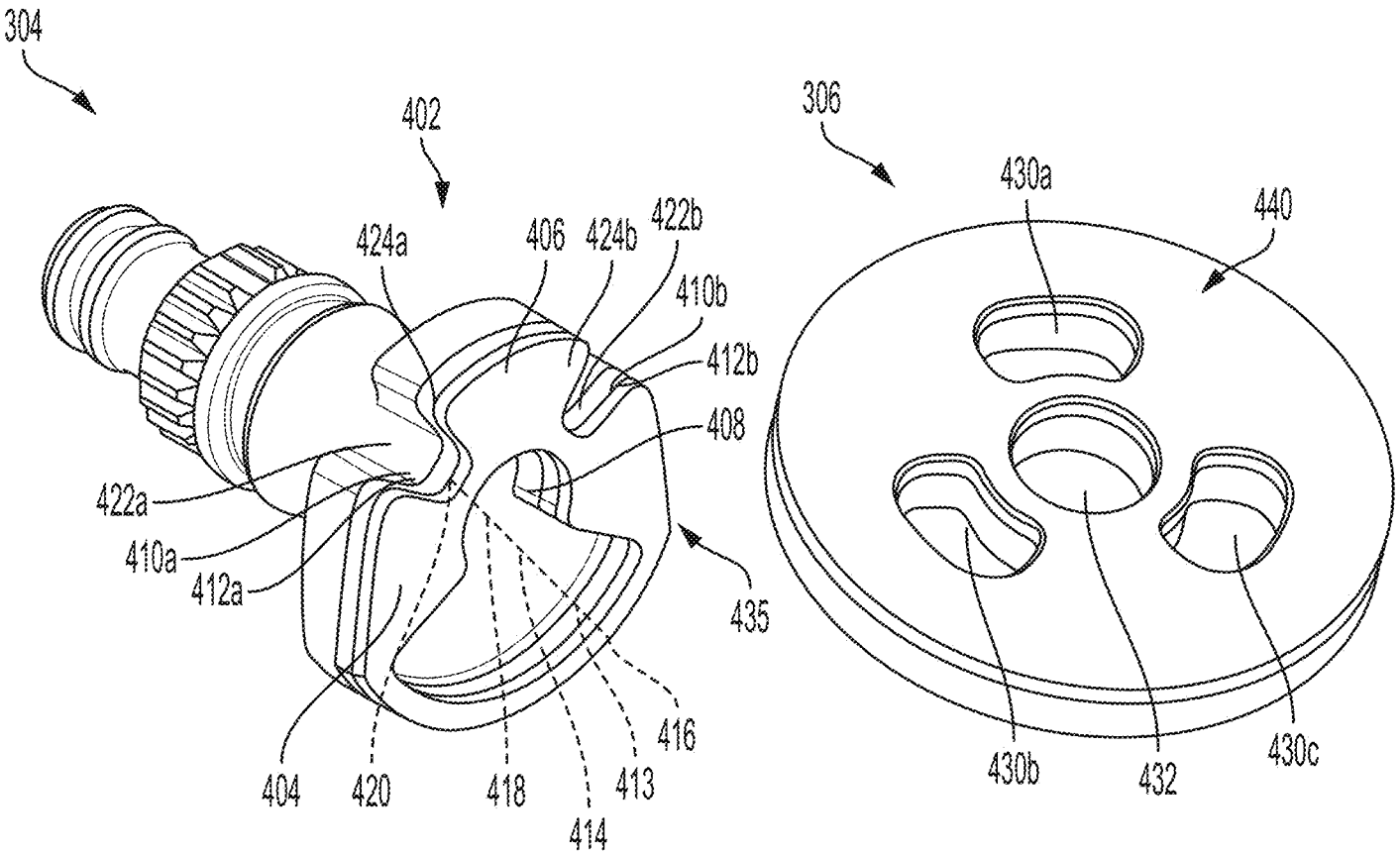
FIG. 4 is a perspective view of a steering valve and a valve seat according to one example of the present disclosure.

FIG. 4 is a perspective view of a steering valve 304 and a valve seat 306 according to one example of the present disclosure. As illustrated, the steering valve 304 includes an open portion 402, a closed portion 404, a cut-off portion 406, and a central channel 408. The open portion 402 may include a first side 410*a* and a second side 410*b*. The closed portion 404 may include a third side 412*a* and a fourth side 412*b*. In some examples, the open portion 402 and the closed portion 404 can be adjacent or otherwise abutting one another. For example, the first side 410*a* can be adjacent or abutting the third side 412*a*, and the second side 410*b* can be adjacent or abutting the fourth side 412*b*, etc. The open portion 402 can generally allow fluid to flow through corresponding channels of the valve seat 306, while the closed portion 404 may prevent fluid from flowing through the corresponding channels of the valve seat 306. For example, a first radius 413 (or radius range), measured from a center 414 of the steering valve 304 to a circumference 416 of the steering valve 304 associated with the closed portion 404, may be greater than a second radius 418 measured from the center 414 of the steering valve 304 to a circumference 420 of the steering valve 304 associated with the open portion 402. The second radius 418 (or radius range) can expose the corresponding channels of the valve seat 306 and allow fluid to flow through the corresponding channels when the open portion 402 with the second radius 418 is positioned over the corresponding channels.

The open portion 402 may additionally include the cut-off portion 406. In some examples, the cut-off portion 406 may divide the open portion 402 into a first flow portion 422*a* and a second flow portion 422*b*. The first flow portion 422*a* may extend from the first side 410*a* of the open portion 402 to a fifth side 424*a* of the cut-off portion 406, and the second flow portion 422*b* may extend from a sixth side 424*b* of the cut-off portion 406 to the second side 410*b* of the open portion 402. The first flow portion 422*a* and the second flow portion 422*b* can allow fluid to flow through corresponding channels of the valve seat 306. For example, when positioned over the corresponding channels, the first flow portion 422*a*, the second flow portion 422*b*, or a combination thereof expose the corresponding channel and allow fluid to flow to activate one or more steering pads of the rotary steerable system 109. Positioning the cut-off portion 406 over one or more channels of the valve seat 306, however, may not expose the one or more channels and may prevent fluid from flowing to deactivate the steering pads of the rotary steerable system 109. The open portion 402, the closed portion 404, the cut-off portion 406, other suitable components of the steering valve 304, or any suitable combination thereof can be otherwise suitably arranged to allow the steering valve 304 to deactivate steering pads of the rotary steerable system 109.

In some examples, the cut-off portion 406 can be sized to correspond to one or more channels 430*a-c* of the valve seat 306. For example, a distance, such as a linear distance, an arc length, or the like, of the cut-off portion 406 measured from the fifth side 424*a* to the sixth side 424*b* can be approximately equal to a length (e.g., linear or arc length) of one or more of the channels 430*a-c*. The cut-off portion 406 can be otherwise sized, shaped, or a combination thereof for covering one or more of the channels 430*a-c* for preventing fluid flow to deactivate steering pads of the rotary steerable system 109.

The steering valve 304 can be positioned in the rotary steerable system 109 adjacent to or otherwise abutting the valve seat 306. For example, a first face 435 of the steering valve 304 can be positioned against a second face 440 of the valve seat 306. The first face 435 may physically contact the second face 440. In some examples, the first face 435 may be positioned proximate to (e.g., such that the cut-off portion 406 can prevent flow to one or more of the channels 430*a-c*) but not physically contacting the second face 440. The first face 435 may be otherwise positioned with respect to the second face 440 to allow the steering valve 304 to rotate to selectively activate or deactivate steering pads of the rotary steerable system 109.

In some examples, the steering valve 304 can be positioned with respect to the valve seat 306 such that the central channel 408 is positioned corresponding to a central channel 432 of the valve seat 306. While described as the central channel 408 and the central channel 432, either or both of the central channel 408 and the central channel 432 can be positioned non-centrally with respect to the steering valve 304, the valve seat 306, or a combination thereof. The central channel 408 can receive fluid flowing from the steering pads via the central channel 432. For example, when the steering valve 304 is positioned to deactivate each of the steering pads of the rotary steerable system 109, fluid from the steering pads may be returned to the surface or otherwise removed from the steering pads to allow the steering pads to deactivate. The fluid can be removed from the steering pads and directed through the central channel 432 of the valve seat 306 to the central channel 408 of the steering valve 304. The fluid can be retained in the steering valve 304, can be returned to the surface, or can be otherwise disposed subsequent to removing the fluid from the steering pads.

Figure 5:
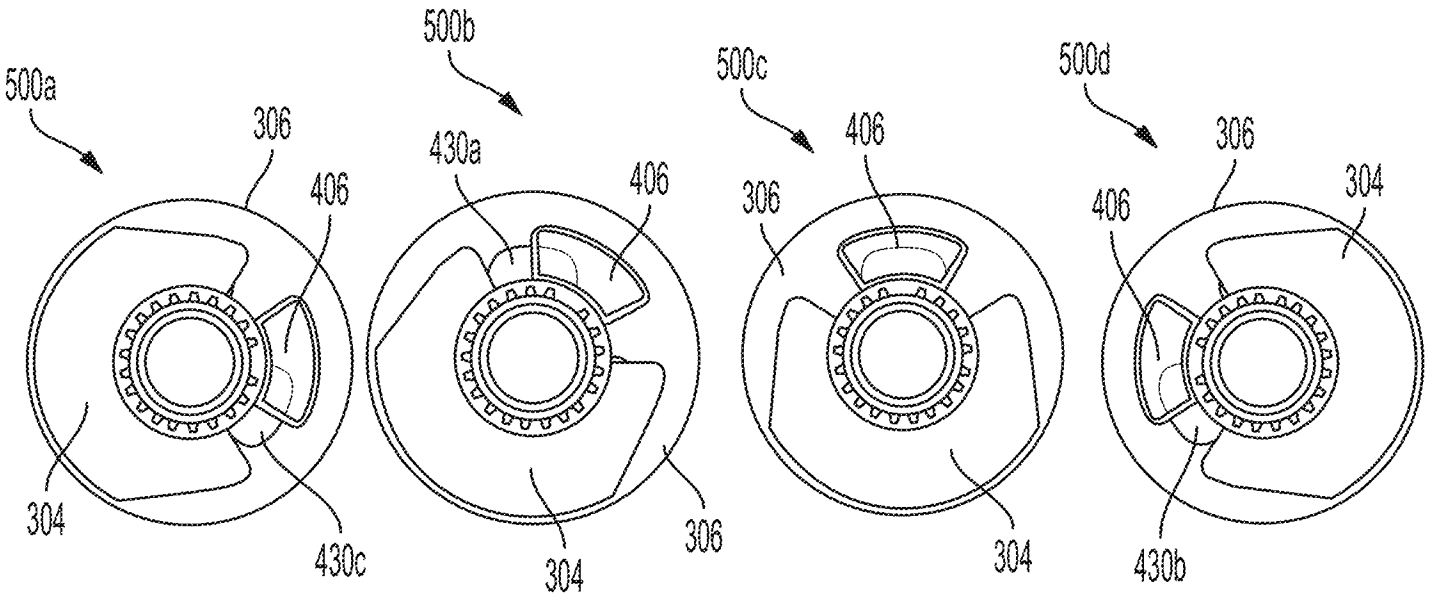
FIG. 5 is a sequence of positions of the steering valve with respect to the valve seat according to one example of the present disclosure.

FIG. 5 is a sequence of positions 500*a-d* of the steering valve 304 with respect to the valve seat 306 according to one example of the present disclosure. As illustrated, the position 500*a* involves the steering valve 304 positioned on the valve seat 306 such that the cut-off portion 406 of the steering valve 304 is partially covering the channel 430*c* of the valve seat 306. Accordingly, the steering valve 304 may allow fluid to flow through the channel 430*c* while the channel 430*c* is at least partially exposed. Additionally, while the cut-off portion 406 partially covers the channel 430*c*, the steering valve 304 may allow a steering pad of the rotary steerable system 109 and corresponding to the channel 430*c* to receive fluid to activate and actuate outward to cause the rotary steerable system 109 to adjust a direction of a drill 202 in the wellbore 118.

In some examples, the open portion 402 of the steering valve 304 may allow 180° of opening with respect to a channel. Stated differently, once the steering valve 304 is rotated to initially expose the channel 430*c* (or other suitable channels of the valve seat 306), the steering valve 304 can be rotated in the same initial direction by approximately 180° before the channel 430*c* is covered by the closed portion 404 of the steering valve 304. The cut-off portion 406 can be positioned within the 180° of the open portion 402, but the cut-off portion 406 can allow one or more channels 430 of the valve seat 306 to be at least partially exposed. For example, the cut-off portion 406 may be sized, shaped, or a combination thereof to cover a corresponding channel 430 of the valve seat 306 in a particular azimuthal configuration of the steering valve 304. In one such example, the cut-off portion 406 can completely cover a particular channel of the valve seat 306 at one angle (or one range of angles) measure of the steering valve 304. The angle measure of the steering valve 304 can be sufficiently small to allow, upon rotating the steering valve 304 in either direction, one or more channels of the valve seat 306 to be at least partially exposed.

As illustrated, the position 500*b* involves the steering valve 304 positioned on the valve seat 306 such that the cut-off portion 406 of the steering valve 304 is partially covering the channel 430*a* of the valve seat 306. Accordingly, the steering valve 304 may allow fluid to flow through the channel 430*a* while the channel 430*a* is at least partially exposed. In some examples, an azimuthal orientation of the steering valve 304 can be adjusted so that two or more channels (e.g., the channel 430*a* and the channel 430*c*, etc.) are partially exposed for allowing fluid flow through the two or more channels. Additionally, while the cut-off portion 406 partially covers the channel 430*a*, the steering valve 304 may allow a steering pad of the rotary steerable system 109 and corresponding to the channel 430*a* to receive fluid to activate and actuate outward to cause the rotary steerable system 109 to adjust a direction of a drill 202 in the wellbore 118.

The position 500*c* may involve the cut-off portion 406 completely covering a corresponding channel, for example the channel 430*a*, of the valve seat 306. The steering valve 304 can be rotated, for example from the position 500*a*, the position 500*b*, or the like, to be orientated in the position 500*c*. The cut-off portion 406, in the position 500*c*, may prevent fluid from flowing through the corresponding channel. Accordingly, the cut-off portion 406 in the position 500*c* may deactivate a steering pad of the rotary steerable system 109 that corresponds to the corresponding channel. In some examples, the closed portion 404 of the steering valve 304 in the position 500*c* may cover the remaining channels of the valve seat 306. Thus, by positioning the cut-off portion 406 to prevent flow of fluid to the corresponding channel, the steering valve 304 can deactivate each of the steering pads included in the rotary steerable system 109.

As illustrated, the position 500*d* involves the steering valve 304 positioned on the valve seat 306 such that the cut-off portion 406 of the steering valve 304 is partially covering the channel 430*b* of the valve seat 306. Accordingly, the steering valve 304 may allow fluid to flow through the channel 430*b* while the channel 430*b* is at least partially exposed. In some examples, an azimuthal orientation of the steering valve 304 can be adjusted so that two or more channels (e.g., the channels 430*a-b*, etc.) are partially exposed for allowing fluid flow through the two or more channels. Additionally, while the cut-off portion 406 partially covers the channel 430*b*, the steering valve 304 may allow a steering pad of the rotary steerable system 109 and corresponding to the channel 430*b* to receive fluid to activate and actuate outward to cause the rotary steerable system 109 to adjust a direction of a drill 202 in the wellbore 118. Other suitable positions of the steering valve 304 are possible, and the steering valve 304 can partially or completely cover zero, one, two, three, or more channels that may be included in the valve seat 306 positioned adjacent to the steering valve 304.

Figure 6:
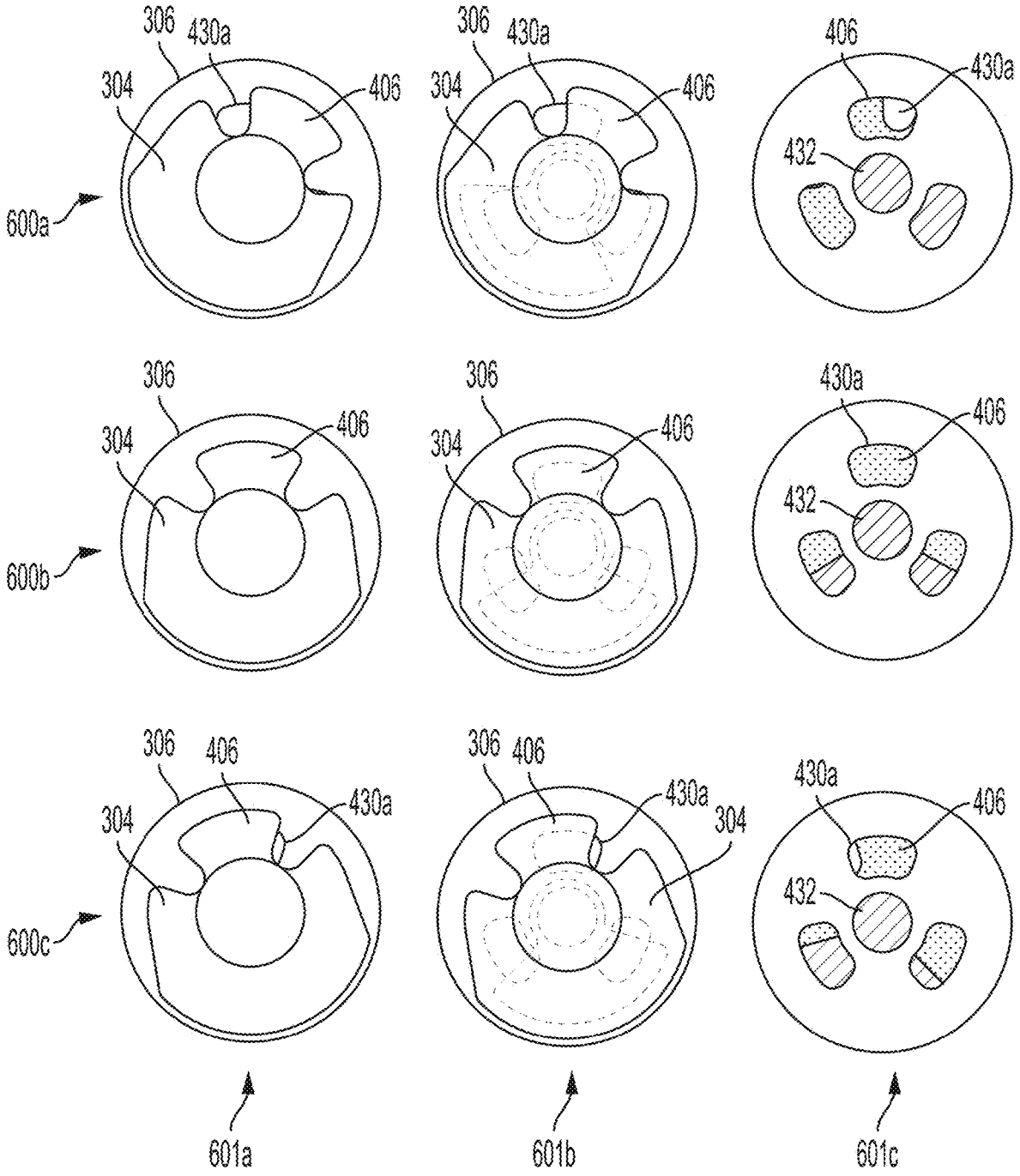
FIG. 6 is a sequence with different views of positions of the steering valve with respect to the valve seat according to one example of the present disclosure.

FIG. 6 is a sequence with different views 601*a-c* of positions 600*a-c* of the steering valve 304 with respect to the valve seat 306 according to one example of the present disclosure. As illustrated, FIG. 6 includes the positions 600*a-c*, which are arranged horizontally as rows, and the different views 601*a-c*, which are arranged vertically as columns. For example, portions of FIG. 6 in a common row (e.g., corresponding to the position 600*a*, etc.) involve different views of a similar position, and portions of FIG. 6 in a common column (e.g., corresponding to one or more views included in the views 601*a*, etc.) involve a similar view of different positions. Additionally, while FIG. 6 is illustrated with respect to the channel 430*a*, similar positions and views are possible for other channels, such as the channels 430*b-c*, etc., of the valve seat 306.

As illustrated, the position 600*a* involves the steering valve 304 positioned on the valve seat 306 such that the cut-off portion 406 of the steering valve 304 is partially covering the channel 430*a* of the valve seat 306. The views 601*a* include a top-view of the position 600*a*, the views 601*b* include a transparent top-view of the position 600*a*, and the views 601*c* include a bottom-view of the position 600*a*. In the position 600*a*, the steering valve 304 may allow fluid to flow through the channel 430*a* while the channel 430*a* is at least partially exposed. Additionally, while the cut-off portion 406 partially covers the channel 430*a*, the steering valve 304 may allow a steering pad of the rotary steerable system 109 and corresponding to the channel 430*a* to receive fluid to activate and actuate outward to cause the rotary steerable system 109 to adjust a direction of a drill 202 in the wellbore 118. The closed portion 404, or any other suitable component, of the steering valve 304 may cover or otherwise block the remaining channels 430*b-c* and may cause steering pads of the rotary steerable system 109 and corresponding to the remaining channels 430*b-c* to be deactivated.

The position 600*b* may involve the cut-off portion 406 completely covering the channel 430*a* of the valve seat 306. The views 601*a* include a top-view of the position 600*b*, the views 601*b* include a transparent top-view of the position 600*b*, and the views 601*c* include a bottom-view of the position 600*b*. The steering valve 304 can be rotated, for example from the position 600*a* to the position 600*b*. The cut-off portion 406, in the position 600*b*, may prevent fluid from flowing through the channel 430*a*. Accordingly, the cut-off portion 406 in the position 600*b* may deactivate a steering pad of the rotary steerable system 109 that corresponds to the channel 430*a*. In some examples, the closed portion 404 of the steering valve 304 in the position 600*b* may cover the remaining channels 430*b-c* of the valve seat 306. Thus, by positioning the cut-off portion 406 to prevent flow of fluid to the channel 430*a*, the steering valve 304 can deactivate each of the steering pads included in the rotary steerable system 109.

As illustrated, the position 600*c* involves the steering valve 304 positioned on the valve seat 306 such that the cut-off portion 406 of the steering valve 304 is partially covering the channel 430*a* (e.g., a different side of the channel 430*a* compared to the position 600*a*) of the valve seat 306. The views 601*a* include a top-view of the position 600*c*, the views 601*b* include a transparent top-view of the position 600*c*, and the views 601*c* include a bottom-view of the position 600*c*. In the position 600*c*, the steering valve 304 may allow fluid to flow through the channel 430*a* while the channel 430*a* is at least partially exposed. Additionally, while the cut-off portion 406 partially covers the channel 430*a*, the steering valve 304 may allow a steering pad of the rotary steerable system 109 and corresponding to the channel 430*a* to receive fluid to activate and actuate outward to cause the rotary steerable system 109 to adjust a direction of a drill 202 in the wellbore 118. The closed portion 404, or any other suitable component, of the steering valve 304 may cover or otherwise block the remaining channels 430*b-c* and may cause steering pads of the rotary steerable system 109 and corresponding to the remaining channels 430*b-c* to be deactivated.

Figure 7:
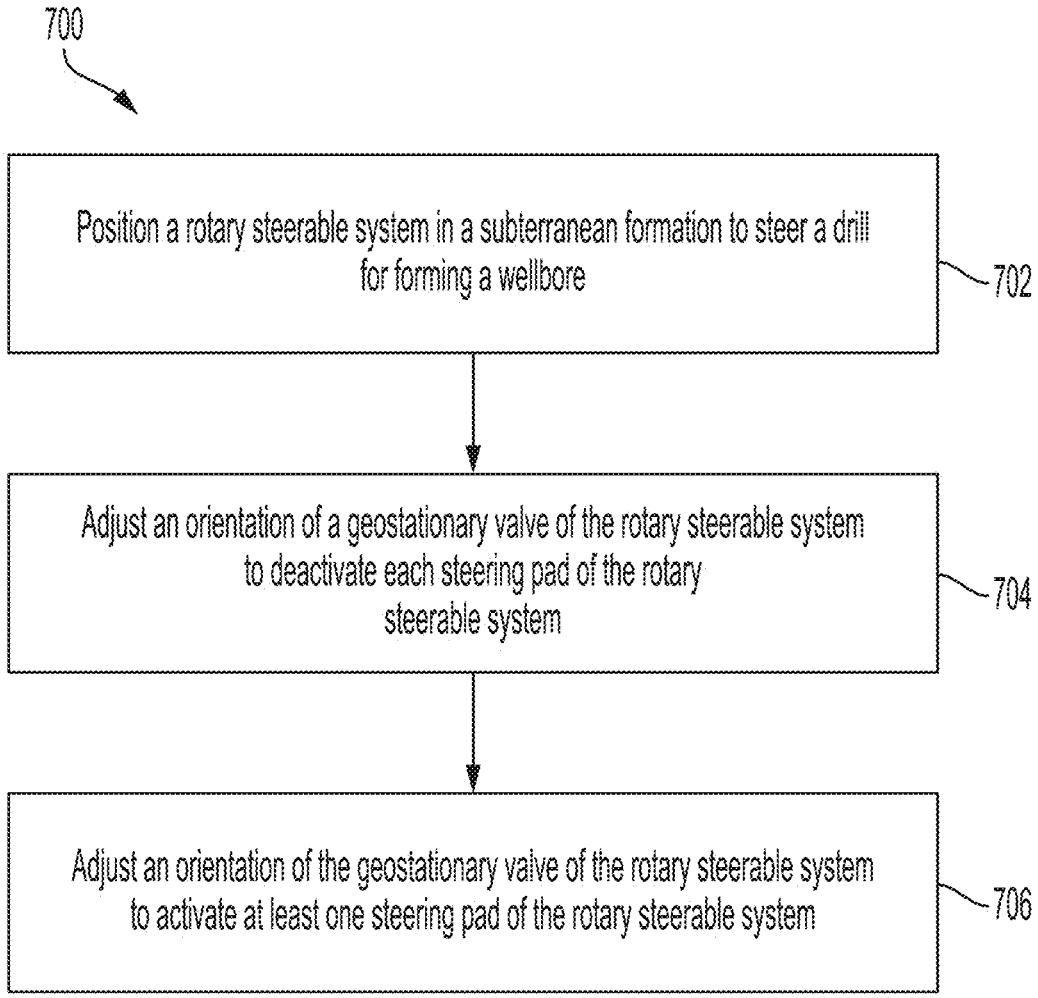
FIG. 7 is a flowchart of a process for deactivating steering pads of a rotary steerable system using a steering valve according to one example of the present disclosure.

FIG. 7 is a flowchart of a process 700 for deactivating steering pads of a rotary steerable system 109 using a steering valve 304 according to one example of the present disclosure. At block 702, the rotary steerable system 109 is positioned in a subterranean formation. The rotary steerable system 109 can be coupled to a drill 202 and other suitable components of a drilling operation. The rotary steerable system 109 can be used to form a wellbore 118. For example, the rotary steerable system 109 can control a direction of the drill 202 to control a shape, depth, or other parameters relating to the wellbore 118 being formed. The rotary steerable system 109 can include one or more steering pads that can be activated or deactivated. For example, fluid can be injected into the subterranean formation or the wellbore 118 to cause the fluid to be directed to one or more of the steering pads of the rotary steerable system 109. A steering pad that receives the fluid can actuate outward to apply a steering force against a wall of the wellbore 118 or other suitable structure. The steering force can cause the direction of the drill 202 to change.

At block 704, an orientation of the steering valve 304 can be adjusted to deactivate at least one steering pad of the rotary steerable system 109. The steering valve 304 can be rotated or otherwise be positioned such that an orientation of the steering valve 304 causes each of the channels of the valve seat 306 to be covered by the steering valve 304. For example, a continuous closed portion of the steering valve 304 can be positioned to cover each of the channels of the valve seat 306 to deactivate each of the steering pads of the rotary steerable system 109. In other examples, a cut-off portion 406 of the steering valve 304 can be positioned over at least one channel of a valve seat 306 positioned adjacent to the steering valve 304 while the closed portion 404 covers the remaining channels of the valve seat 306. The at least one channel may correspond to at least one steering pad of the rotary steerable system 109. For example, fluid that flows through the at least one channel may be directed to the at least one steering pad for activating the steering pad. But, the cut-off portion 406 may prevent fluid from flowing through the at least one channel. Additionally, the orientation of the steering valve 304 may involve a closed portion 404 of the steering valve 304 covering the remaining channels of the valve seat 306. Accordingly, the steering pads of the rotary steerable system 109 may be deactivated by the steering valve 304 in the present orientation.

In some examples, the steering valve 304 can be used as a non-steering valve. For example, the steering valve 304 can be coupled to a drill string or other suitable component of a drilling operation that may rotate to cause the drill 202 to rotate. The steering valve 304 can be positioned such that the steering pads are deactivated and such that the steering valve 304 is held stationary with respect to the drill string or other suitable component. Accordingly, the cut-off portion 406 of the steering valve 304 can be held stationary to deactivate one or more of the steering pads for an extended period of time, which may be predetermined.

In some examples, downhole electronics can control the steering valve 304. For example, the rotary steerable system 109 or other suitable components communicatively coupled to the rotary steerable system 109 can include sensors that can indicate one or more locations of the rotary steerable system 109 or any suitable component thereof such as a steering pad. Based on sensor signals, a motor that can control the steering valve 304 can be controlled to cause the steering valve 304 to adjust orientation. For example, the sensors may indicate that a tool face angle of the drill 202 should be adjusted, and the motor can be controlled to cause the steering valve 304 to rotate or otherwise change orientations to deactivate or activate corresponding steering pads to achieve the tool face angle adjustment.

In some examples, the valve seat 306 may include channels that are radially offset, azimuthally offset, or a combination thereof. For example, the channels of the valve seat 306 may be equally or unequally distributed azimuthally around the valve seat 306 on a similar radius. In other examples, the channels may be similarly shaped or sized and may be positioned on different radii of the valve seat 306. In yet other examples, the radial position and the azimuthal position of the channels of the valve seat 306 may be different among each channel of the valve seat 306. In any of the preceding examples, the steering valve 304, or any component or components thereof, such as the open portion 402, the closed portion 404, the cut-off portion 406, etc., may be designed or otherwise arranged to be used with the corresponding design of the channels of the valve seat 306 to deactivate the steering pads of the rotary steerable system 109. In some of these examples, the steering valve 304 may include more (e.g., more than three portions may be included with respect to the steering valve 304) or fewer (e.g., one or more of the open portion 402, the closed portion 404, or the cut-off portion 406 may be omitted) portions.

At block 706, an orientation of the steering valve 304 can be adjusted to activate at least one steering pad of the rotary steerable system 109. The steering valve 304 can be rotated or otherwise be positioned such that an orientation of the steering valve 304 causes the open portion 402 of the steering valve 304 to at least partially expose at least one channel of the valve seat 306. In other examples, an orientation of the cut-off portion 406 of the steering valve 304 can be positioned partially over (or partially not over) at least one channel of a valve seat 306 positioned adjacent to the steering valve 304. The at least one channel may correspond to at least one steering pad of the rotary steerable system 109. For example, fluid that flows through the at least one channel may be directed to the at least one steering pad for activating the steering pad. And, the orientation of the steering valve 304 may allow fluid to flow through the at least one channel. Accordingly, the at least one steering pad of the rotary steerable system 109 may be activated by the steering valve 304 in the present orientation and may actuate for controlling a direction of the drill 202.

Figure 8:
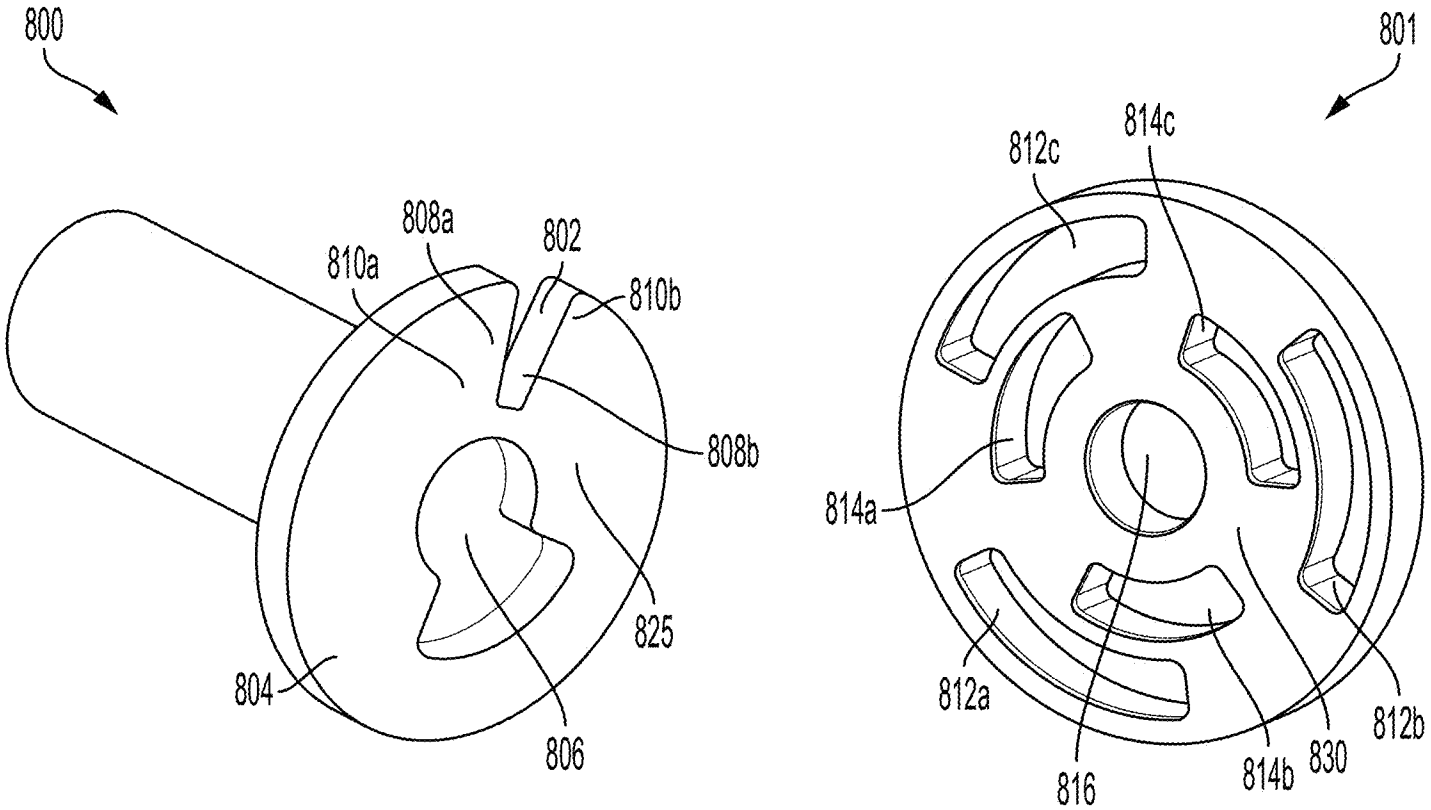
FIG. 8 is a perspective view of a different steering valve and a different valve seat according to one example of the present disclosure.

FIG. 8 is a perspective view of a different steering valve 800 and a different valve seat 801 according to one example of the present disclosure. As illustrated, the steering valve 800 includes an open portion 802, a closed portion 804, and a central channel 806. The open portion 802 may include a first side 808*a* and a second side 808*b*. The closed portion 804 may include a third side 810*a* and a fourth side 810*b*. In some examples, the open portion 802 and the closed portion 804 can be adjacent or otherwise abutting one another. For example, the first side 808*a* can be adjacent or abutting the third side 810*a*, and the second side 808*b* can be adjacent or abutting the fourth side 810*b*, etc. The open portion 802 can generally allow fluid to flow through corresponding channels of the valve seat 801, while the closed portion 804 may prevent fluid from flowing through the corresponding channels of the valve seat 801.

In some examples, the open portion 802 can be sized to correspond to one or more outer channels 812*a-c* and one or more inner channels 814*a-c* of the valve seat 801. For example, a distance, such as a linear distance, an arc length, or the like, of the open portion 802 measured from the first side 808*a* to the second side 808*b* can be approximately equal to a length (e.g., linear or arc length) between respective outer channels 812*a-c* and inner channels 814*a-c*. The open portion 802 can be otherwise sized, shaped, or a combination thereof for allowing the closed portion 804 to cover one or more of the outer channels 812*a-c* and inner channels 814*a-c* for preventing fluid flow that causes the steering pads of the rotary steerable system 109 to deactivate.

The steering valve 800 can be positioned in the rotary steerable system 109 adjacent to or otherwise abutting the valve seat 801. For example, a first face 825 of the steering valve 800 can be positioned against a second face 830 of the valve seat 801. The first face 825 may physically contact the second face 830. In some examples, the first face 825 may be positioned proximate to (e.g., such that the closed portion 804 can prevent flow to one or more of the outer channels 812*a-c* and the inner channels 814*a-c*) but not physically contacting the second face 830. The first face 825 may be otherwise positioned with respect to the second face 830 to allow the steering valve 800 to rotate to selectively activate or deactivate steering pads of the rotary steerable system 109.

In some examples, the steering valve 800 can be positioned with respect to the valve seat 801 such that the central channel 806 is positioned corresponding to a central channel 816 of the valve seat 801. While described as the central channel 806 and the central channel 816, either or both of the central channel 806 and the central channel 816 can be positioned non-centrally with respect to the steering valve 800, the valve seat 801, or a combination thereof. The central channel 806 can receive fluid flowing from the steering pads via the central channel 816. For example, when the steering valve 800 is positioned to deactivate each of the steering pads (e.g., when the closed portion 804 covers each of the outer channels 812*a-c* and each of the inner channels 814*a-c*) of the rotary steerable system 109, fluid from the steering pads may be returned to the surface or otherwise removed from the steering pads to allow the steering pads to deactivate. The fluid can be removed from the steering pads and directed through the central channel 816 of the valve seat 801 to the central channel 806 of the steering valve 800, etc. The fluid can be retained in the steering valve 800, can be returned to the surface, or can be otherwise suitably disposed subsequent to removing the fluid.

In some examples, one or more of the outer channels 812*a-c* can correspond to one or more of the inner channels 814*a-c*. As illustrated, the outer channel 812*a* corresponds to the inner channel 814*a* such that fluid flowing through either the outer channel 812*a* or the inner channel 814*a* may cause a first steering pad of the rotary steerable system 109 to actuate. Additionally, the outer channel 812*b* can correspond to the inner channel 814*b* such that fluid flowing through either the outer channel 812*b* or the inner channel 814*b* may cause a second steering pad of the rotary steerable system 109 to actuate. Additionally, the outer channel 812*c* can correspond to the inner channel 814*c* such that fluid flowing through either the outer channel 812*c* or the inner channel 814*c* may cause a third steering pad of the rotary steerable system 109 to actuate, etc.

Figure 9:
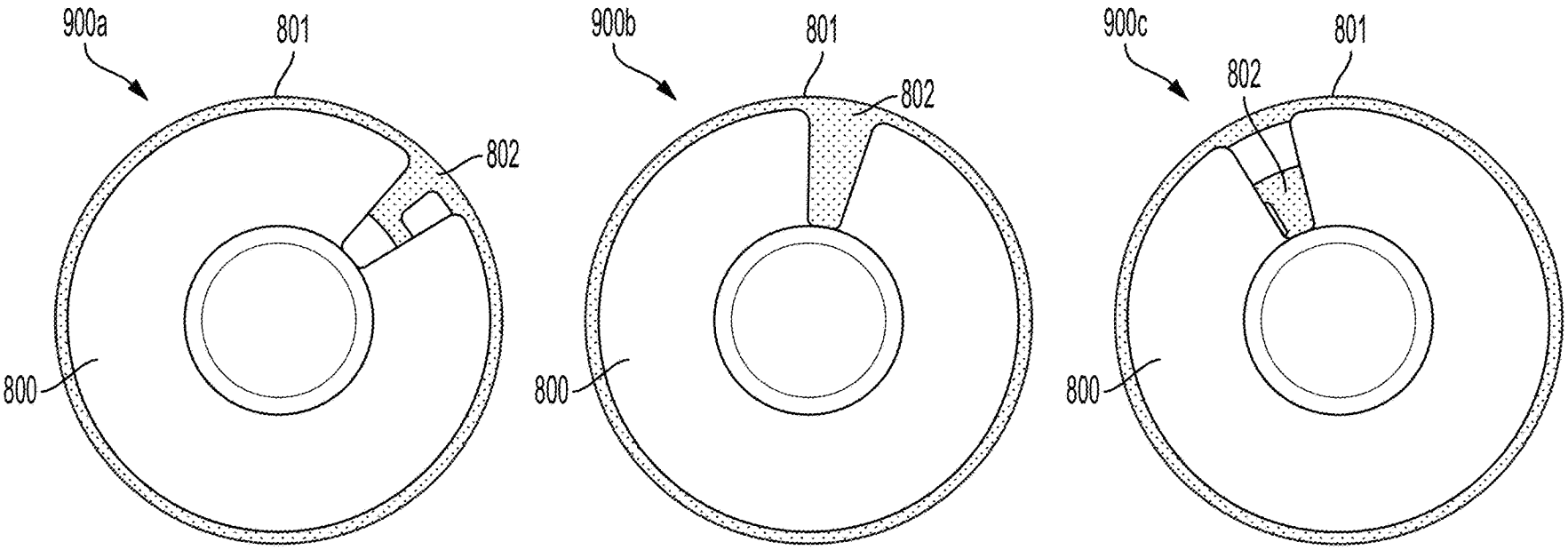
FIG. 9 is a sequence of positions of the different steering valve with respect to the different valve seat according to one example of the present disclosure.

FIG. 9 is a sequence of positions 900*a-c* of the different steering valve 800 with respect to the different valve seat 801 according to one example of the present disclosure. As illustrated, the position 900*a* involves the steering valve 800 positioned on the valve seat 801 such that the open portion 802 of the steering valve 800 is partially exposing the inner channel 814*c* and the outer channel 812*a* of the valve seat 801. Accordingly, the steering valve 800 may allow fluid to flow through the inner channel 814*c* and the outer channel 812*a* while the respective channels are at least partially exposed. Additionally, the steering valve 800 may allow one or more steering pads of the rotary steerable system 109 and corresponding to the inner channel 814*c* and the outer channel 812*a* to receive fluid to activate and actuate outward to cause the rotary steerable system 109 to adjust a direction of a drill 202 in the wellbore 118.

The position 900*b* may involve the open portion 802 not exposing any channels, for example outer channels 812*a-c* or inner channels 814*a-c*, of the valve seat 801. Stated differently, the closed portion 804 may cover each of the outer channels 812*a-c* and each of the inner channels 814*a-c*. The steering valve 800 can be rotated, for example from the position 900*a*, to be orientated in the position 900*b*. The open portion 802, in the position 900*b*, may not allow fluid from flowing through any channels of the valve seat 801. Thus, by positioning the closed portion 804 to prevent flow of fluid to the channels of the valve seat 801, the steering valve 800 can deactivate each of the steering pads included in the rotary steerable system 109.

As illustrated, the position 900*c* involves the steering valve 800 positioned on the valve seat 801 such that the open portion 802 of the steering valve 800 is at least partially exposing the outer channel 812*b* and the inner channel 814*a* of the valve seat 801. Accordingly, the steering valve 800 may allow fluid to flow through the outer channel 812*b* and the inner channel 814*a* while the respective channels are at least partially exposed. In some examples, an azimuthal orientation of the steering valve 800 can be adjusted so that two or more channels corresponding to different steering pads are at least partially exposed for allowing fluid flow through the two or more channels to the corresponding different steering pads. Additionally, while the closed portion 804 partially covers the outer channel 812*b* and the inner channel 814*a*, the steering valve 800 may allow one or more steering pads of the rotary steerable system 109 and corresponding to the outer channel 812*b* and the inner channel 814*a* to receive fluid to activate and actuate outward to cause the rotary steerable system 109 to adjust a direction of a drill 202 in the wellbore 118. Other suitable positions of the steering valve 800 are possible, and the steering valve 800 can partially or completely cover zero, one, two, three, four, five, six or more channels (in some examples, all of the channels) that may be included in the valve seat 801 positioned adjacent to the steering valve 800.

In some aspects, methods, steering valves, and systems for a steering valve for deactivating a rotary steerable system are provided according to one or more of the following examples:

As used below, any reference to a series of examples is to be understood as a reference to each of those examples disjunctively (e.g., "Examples 1-4" is to be understood as "Examples 1, 2, 3, or 4").

Example 1 is a method comprising: positioning a rotary steerable drilling system in a subterranean formation to steer a drill to form a wellbore in the subterranean formation; adjusting an orientation of a steering valve, which is positioned in the rotary steerable drilling system, to cover each channel of one or more channels of a valve seat adjacent the steering valve to deactivate each steering pad of one or more steering pads of the rotary steerable drilling system; and adjusting the orientation of the steering valve to activate at least one steering pad of the one or more steering pads of the rotary steerable drilling system.

Example 2 is the method of example 1, wherein: adjusting the orientation of the steering valve to deactivate each steering pad includes adjusting an orientation of a cut-off portion of the steering valve to cover at least one channel of the one or more channels of the valve seat to deactivate the at least one steering pad of the one or more steering pads of the rotary steerable drilling system; the cut-off portion is positioned within an open portion of the steering valve; and adjusting the orientation of the steering valve to activate the at least one steering pad includes adjusting the orientation of the cut-off portion to activate the at least one steering pad.

Example 3 is the method of any of examples 1-2, wherein adjusting the orientation of the cut-off portion comprises adjusting an orientation of a closed portion of the steering valve such that the closed portion covers the remaining channels of the one or more channels of the valve seat, wherein a first radius of the closed portion and a second radius of the cut-off portion are substantially the same.

Example 4 is the method of any of examples 1-3, wherein: the open portion further comprises a first radius range extending from a center of the steering valve to a first outer surface of the steering valve corresponding to the closed portion; the closed portion further comprises a second radius range extending from the center of the steering valve to a second outer surface of the steering valve corresponding to the open portion, wherein the second radius range is greater than the first radius range; and adjusting the orientation of the steering valve to cover each channel includes adjusting an orientation of the closed portion such that the second radius range covers each of the one or more channels of the valve seat.

Example 5 is the method of any of examples 1-2, wherein: a first end of a closed portion of the steering valve abuts a second end of the open portion; a third end of the closed portion is positioned opposite the first end and abuts a fourth end of the open portion; and the cut-off portion is positioned between the second end and the fourth end.

Example 6 is the method of example 1, wherein adjusting the orientation of the steering valve to deactivate each steering pad comprises rotating a continuous open portion of the steering valve such that no channel of the one or more channels of the valve seat is exposed.

Example 7 is the method of any of examples 1 and 6, wherein adjusting the orientation of the steering valve to deactivate each steering pad comprises rotating a continuous closed portion of the steering valve such that each channel of the one or more channels of the valve seat is covered by the continuous closed portion, wherein the continuous open portion and the continuous closed portion are adjacent one another in the steering valve.

Example 8 is a steering valve comprising: an open portion positionable in a rotary steerable system to allow fluid to flow to one or more steering pads of the rotary steerable system via one or more channels of a valve seat positionable adjacent the steering valve; and a continuous closed portion positioned adjacent the open portion in the rotary steerable system, an orientation of the continuous closed portion adjustable to cover each of the one or more channels of the valve seat to deactivate each of the one or more steering pads of the rotary steerable system.

Example 9 is the steering valve of example 8, wherein: the continuous closed portion comprises: a first end abutting a second end of the open portion; a third end positioned opposite the first end and abutting a fourth end of the open portion; and the open portion comprises: the second end abutting the first end of the continuous closed portion; the fourth end positioned opposite the third end and abutting the third end of the continuous closed portion; and a cut-off portion positioned between the second end and the fourth end, the cut-off portion positionable to cover at least one channel of the one or more channels of the valve seat to deactivate at least one steering pad of a rotary steerable drilling system.

Example 10 is the steering valve of any of examples 8-9, wherein the orientation of the continuous closed portion is adjustable to cover a first subset of the one or more channels while an orientation of the cut-off portion is adjustable to cover a second subset of the one or more channels, and wherein a union of the first subset and the second subset is the one or more channels.

Example 11 is the steering valve of any of examples 8-9, wherein the open portion further comprises: a first flow portion extending between the second end of the open portion and a fifth end of the cut-off portion; and a second flow portion extending between a sixth end of the cut-off portion and the fourth end of the open portion, wherein the sixth end is positioned opposite the fifth end with respect to the cut-off portion.

Example 12 is the steering valve of any of examples 8 and 11, wherein the orientation of the cut-off portion is adjustable to cover a particular channel of the one or more channels of the valve seat to deactivate a particular steering pad of the one or more steering pads of the rotary steerable drilling system, wherein the orientation of the cut-off portion is positionable in a particular orientation that causes each steering pad of the rotary steerable drilling system to be deactivated.

Example 13 is the steering valve of example 8, wherein: the open portion further comprises a first radius range extending from a center of the steering valve to a first outer surface of the steering valve corresponding to the continuous closed portion; and the continuous closed portion further comprises a second radius range extending from the center of the steering valve to a second outer surface of the steering valve corresponding to the open portion, wherein the second radius range is greater than the first radius range, and wherein the second radius range is usable to cover the one or more channels of the valve seat.

Example 14 is the steering valve of any of examples 8 and 13, wherein: a cut-off portion of the open portion of the steering valve comprises a third radius range that is substantially the same as the second radius range; and fluid flow through the one or more channels is preventable by positioning the continuous closed portion and the cut-off portion to cover the one or more channels such that the second radius range extends from at least a first side of the one or more channels to at least a second side of the one or more channels.

Example 15 is a system comprising: a valve seat positionable in a rotary steerable drilling system, the valve seat comprising one or more channels; and a steering valve positionable in the rotary steerable drilling system adjacent to the valve seat, the steering valve comprising: an open portion positionable in a rotary steerable system to allow fluid to flow to one or more steering pads of the rotary steerable system via the one or more channels; and a continuous closed portion positioned adjacent the open portion in the rotary steerable system, an orientation of the continuous closed portion adjustable to cover each of the one or more channels of the valve seat to deactivate each of the one or more steering pads of the rotary steerable system.

Example 16 is the system of example 15, wherein: the continuous closed portion comprises: a first end abutting a second end of the open portion; a third end positioned opposite the first end and abutting a fourth end of the open portion; and the open portion comprises: the second end abutting the first end of the continuous closed portion; the fourth end positioned opposite the third end and abutting the third end of the continuous closed portion; and a cut-off portion positioned between the second end and the fourth end, the cut-off portion positionable to cover at least one channel of the one or more channels of the valve seat to deactivate at least one steering pad of a rotary steerable drilling system.

Example 17 is the system of any of examples 15-16, wherein the orientation of the continuous closed portion is adjustable to cover a first subset of the one or more channels while an orientation of the cut-off portion is adjustable to cover a second subset of the one or more channels, and wherein a union of the first subset and the second subset is the one or more channels.

Example 18 is the system of any of examples 15-16, wherein the open portion further comprises: a first flow portion extending between the second end of the open portion and a fifth end of the cut-off portion; and a second flow portion extending between a sixth end of the cut-off portion and the fourth end of the open portion, wherein the sixth end is positioned opposite the fifth end with respect to the cut-off portion.

Example 19 is the system of any of examples 15 and 18, wherein the orientation of the cut-off portion is adjustable to cover a particular channel of the one or more channels of the valve seat to deactivate a particular steering pad of the one or more steering pads of the rotary steerable drilling system, wherein the orientation of the cut-off portion is positionable in a particular orientation that causes each steering pad of the rotary steerable drilling system to be deactivated.

Example 20 is the system of example 15, wherein: the open portion further comprises a first radius range extending from a center of the steering valve to a first outer surface of the steering valve corresponding to the continuous closed portion; and the continuous closed portion further comprises a second radius range extending from the center of the steering valve to a second outer surface of the steering valve corresponding to the open portion, wherein the second radius range is greater than the first radius range, and wherein the second radius range is usable to cover the one or more channels of the valve seat.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A system comprising:

a valve seat positionable in a rotary steerable drilling system and comprising a plurality of channels through which fluid can flow to control activation of three or more steering pads during operation of the rotary steerable drilling system; and a steering valve positionable in the rotary steerable drilling system adjacent to the valve seat, wherein the steering valve can rotate relative to the valve seat to control a flow of fluid through the plurality of channels such that:

the three or more steering pads are activated and deactivated in a sequential order based on rotation of the steering valve relative to the valve seat;

each of the three or more steering pads are activated for more than or equal to 120° of rotation of the steering valve relative to the valve seat; and the flow of fluid through the plurality of channels is blocked to all of the three or more steering pads at a specific orientation of the steering valve relative to the valve seat.

2. The system of claim 1, wherein each of the three or more steering pads are activated for 180° of rotation of the steering valve relative to the valve seat.

3. The system of claim 1, wherein the steering valve includes a cut-off portion that covers at least one channel of the plurality of channels of the valve seat at the specific orientation of the steering valve relative to the valve seat such that:

the cut-off portion deactivates a steering pad of the three or more steering pads; and the steering valve with the cut-off portion blocks the flow of fluid through plurality of channels to all of the three or more steering pads.

4. The system of claim 3, wherein the cut-off portion is positioned in an open portion of the steering valve.

5. The system of claim 3, wherein the cut-off portion is sized to simultaneously cover two or more channels of the plurality of channels thereby deactivating two or more steering pads of the three or more steering pads that correspond to the two or more channels of the plurality of channels.

6. The system of claim 1, wherein the steering valve includes a closed portion that covers a channel of the plurality of channels of the valve seat and prevents the flow of the fluid through the channel to deactivate a steering pad of the three or more steering pads in the sequential order.

7. The system of claim 6, wherein the steering valve includes an open portion that allows the flow of the fluid through a channel of the plurality of channels of the valve seat to activate a steering pad of the three or more steering pads in the sequential order.

8. The system of claim 7, wherein the closed portion and the open portion of the steering valve are adjacent to each other.

9. The system of claim 7, wherein the closed portion and the open portion are sized adjacent to each other such that the open portion allows fluid to flow through the channel to activate the steering pad for 180° of rotation of the steering valve relative to the valve seat.

10. The system of claim 1, wherein the steering valve comprises a central channel configured to receive fluid from the three or more steering pads, thereby allowing the three or more steering pads to deactivate when the flow of fluid through the plurality of channels to all of the three or more steering pads at the specific orientation of the steering valve relative to the valve seat.

11. The method of claim 10, wherein the steering valve includes a closed portion that covers a channel of the plurality of channels of the valve seat and prevents the flow of the fluid through the channel to deactivate a steering pad of the three or more steering pads in the sequential order.

12. The method of claim 11, wherein the steering valve includes an open portion that allows the flow of the fluid through a channel of the plurality of channels of the valve seat to activate a steering pad of the three or more steering pads in the sequential order.

13. The method of claim 12, wherein the closed portion and the open portion of the steering valve are adjacent to each other.

14. The method of claim 12, wherein the closed portion and the open portion are sized adjacent to each other such that the open portion allows fluid to flow through the channel to activate the steering pad for 180° of rotation of the steering valve relative to the valve seat.

15. The method of claim 10, wherein the steering valve comprises a central channel configured to receive fluid from the three or more steering pads, thereby allowing the three or more steering pads to deactivate when the flow of fluid through the plurality of channels to all of the three or more steering pads at the specific orientation of the steering valve relative to the valve seat.

16. A method comprising:

positioning a rotary steerable drilling system in a subterranean formation to steer a drill string to form a wellbore in the subterranean formation, wherein the rotary steerable drilling system comprises:

a valve seat comprising a plurality of channels through which fluid can flow to control activation of three or more steering pads; and a steering valve in the rotary steerable drilling system adjacent to the valve seat and configured to rotate relative to the valve seat;

adjusting an orientation of the steering valve relative to the valve seat in the rotary steerable drilling system to control a flow of fluid through the plurality of channels and cause activation and deactivation of the three or more steering pads in a sequential order, wherein:

each of the three or more steering pads are activated for more than or equal to 120° of rotation of the steering valve relative to the valve seat; and the flow of fluid through the plurality of channels is blocked to all of the three or more steering pads at a specific orientation of the steering valve relative to the valve seat.

17. The method of claim 16, wherein each of the three or more steering pads are activated for 180° of rotation of the steering valve relative to the valve seat.

18. The method of claim 16, wherein the steering valve includes a cut-off portion that covers at least one channel of the plurality of channels of the valve seat at the specific orientation of the steering valve relative to the valve seat such that:

the cut-off portion deactivates a steering pad of the three or more steering pads; and the steering valve with the cut-off portion blocks the flow of fluid through plurality of channels to all of the three or more steering pads.

19. The method of claim 18, wherein the cut-off portion is positioned in an open portion of the steering valve.

20. The method of claim 18, wherein the cut-off portion is sized to simultaneously cover two or more channels of the plurality of channels thereby deactivating two or more steering pads of the three or more steering pads that correspond to the two or more channels of the plurality of channels.

* * * * *